United States Patent [19]

Hashimoto

[11] 4,290,199

[45] Sep. 22, 1981

[54] CUTTING APPARATUS FOR A RUSTY NUT

[76] Inventor: Shuji Hashimoto, No. 197-1, Uchihashi, Kasuya-Cho, Kasuya-District, Fukuoka-Pref., Japan

[21] Appl. No.: 90,775

[22] Filed: Nov. 2, 1979

[30] Foreign Application Priority Data

Sep. 26, 1979 [JP] Japan ..... 54-132050[U]

[51] Int. Cl.[3] ..... B26B 17/00

[52] U.S. Cl. ..... 30/180

[58] Field of Search ..... 30/180, 186, 187, 179, 30/233; 116/271

[56] References Cited

U.S. PATENT DOCUMENTS

| | | | |
|---|---|---|---|
| 892,968 | 7/1908 | Vejrosta | 30/179 |
| 2,939,211 | 6/1960 | Daniels | 30/187 |
| 4,044,465 | 8/1977 | Shuji | 30/180 |

FOREIGN PATENT DOCUMENTS

| | | | |
|---|---|---|---|
| 1223942 | 2/1960 | France | 30/180 |

*Primary Examiner*—Jimmy C. Peters

*Attorney, Agent, or Firm*—Jordan and Hamburg

[57] ABSTRACT

A cutting apparatus for a rusty nut comprising two cutting blades fixed on top inside portions of arms, two arms coupled in counter position by axes, indicator plate fixed on the axes, adjusting members such as springs acted separately fixed between a stud bolt settled on center position of the plate and each of the arms.

6 Claims, 3 Drawing Figures

CUTTING APPARATUS FOR A RUSTY NUT

Figure 1:
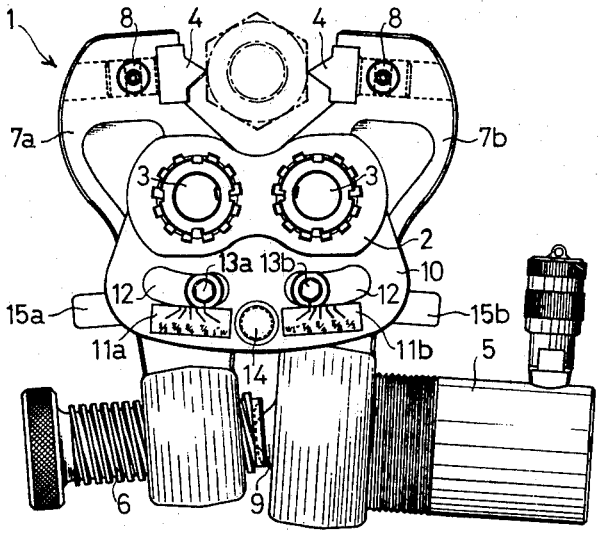

This invention relates to a cutting apparatus for a rusty nut which can not be removed from a bolt by a common tool such as a spanner, and an improvement of a cutting apparatus described in U.S. Pat. No. 4,044,465 to Hashimoto.

Said conventional cutting apparatus attains the following technical objects, according to constructions described in the above patent and drawings.

1. It is an object to disclose a cutting apparatus for a rusty nut designed to have a construction in which a pressure mechanism formed on an end portion of an arm pushes on a receiving member formed on an end portion of another arm, enabling use of the principle of the lever. Accordingly, this construction generates a high level of cutting power as compared with a low level of power generated by the pressure mechanism, and enables making the apparatus of small size and right weight.

2. It is an object to disclose a cutting apparatus for a rusty nut designed to have a construction which enables avoiding enclosing a full face of the nut, and holding only side faces, for enabling cutting off and removal of a rusty nut which is fixed on a bolt in a narrow space between the periphery or the upper face of the nut and a body on which the nut is fixed.

3. It is an object to disclose a cutting apparatus for a rusty nut designed to have a construction which enables changing the previous distance between a blade and another one as it is necessary, for the efficient cutting off of nuts of several different diameters by one type of a cutting apparatus.

4. It is an object to disclose a cutting apparatus for a rusty nut designed to have a construction in which two blades fixed on top inside portions of arms can be moved in directions so that both blades approach each other simultaneously, in order to cut off a nut reliably and in only a short period of time.

Moreover, in the above mentioned U.S. Patent, the following construction is described to attain the above object 4, namely; two arms placed in counter position are fixed indirectly to each other by axes mounted freely on middle portions of the arms, a pair of gears is fixed on said axes and bite each other, and a link plate by which said axes are fixed is freely rotatable.

Accordingly, in the above cutting apparatus, two arms can be moved simultaneously closer and closer by operation of a pair of gears, however, this construction includes a disadvantage described below. When the cutting apparatus is operated, if one side of the arm is contacted with a nearby member such as a body of a construction or iron pole, power generated by a pressure mechanism is added to only the other arm, and it always occurs that the gears fixed to each other are destroyed. In case the gear is destroyed, the two arms are not moved simultaneously, so the cutting operation is not done in little time. Because only one reversal spring is fixed directly between two arms, and a function of this member is equally applied to the arms, if a cutting blade fixed on one side of an arm intrudes into a rusty nut more deeply than other cutting blade, this lack of balance can not be corrected by said reversal spring.

The present invention has been created to overcome the above disadvantage, and the first object of the present invention is to disclose a cutting apparatus for a rusty nut which enables overcoming the above disadvantages, and attaining the technical objects described above in 1 through 4.

The second object of the present invention is to disclose a cutting apparatus for a rusty nut in which a balance regulating mechanism, such as a pair of spring acting separately, regulating the balance of movement of arms, is used instead of a gear mechanism used for simultaneous mechanism of movement of arms.

The third object of the present invention is to disclose a cutting apparatus for a rusty nut providing an indicator member which indicates that three points, namely the center of a nut, the center of a member on which spring for a regulator is fixed, and a connection point of an adjustable screw and a top member of a piston rod, are put in a straight line, and a distance between a cutting blade and another can be set easily according to a diameter of a nut to be cut off.

The fourth object of the present invention is to disclose a cutting apparatus for a rusty nut wherein use of a reversal spring of the conventional apparatus can be omitted, because a balance regulating member has a function as same as said reversal spring.

Figure 2:
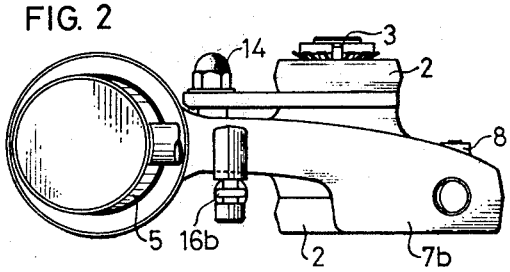
Figure 3:
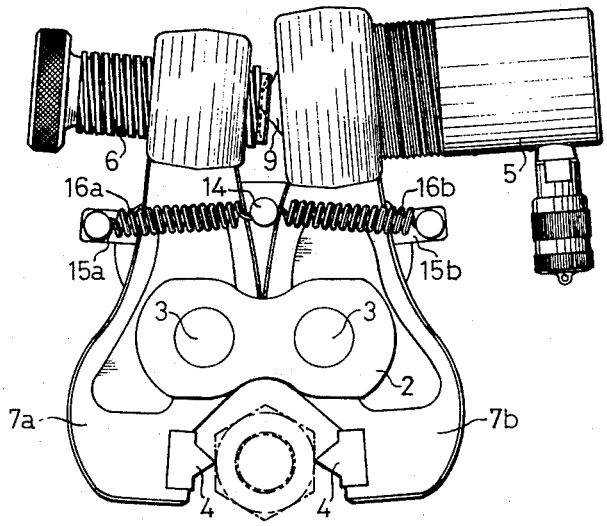

These and other objects as well as merits of the present invention will be apparent from the following detailed description of embodiments with reference to the accompanying drawing, wherein FIG. 1 is a plan view showing an embodiment of the present invention, FIG. 2 is a right side view thereof, and FIG. 3 is a bottom view thereof.

There will be now described an embodiment of the present invention. In FIG. 1, numeral 1 represents a main member of a cutting apparatus which includes a power actuator, not shown, such as an oil pressure pump, a high pressure hose and other parts. Said main member 1 comprises two arms *7a* and *7b* placed in counter position by axes 3 and 3 fixed on plates 2 and 2, and on top inside portions of the arms, cutting blades 4 and 4 are fixed, and on the other hand, a hydraulic cylinder 5 and a movable member such as a screw 6 are freely adjustably fixed on end portions of the arms. Numeral 4 represents a pair of cutting blades of which leg portions are removably inserted into holes formed on top inside portions of the arms *7a* and *7b*, and fixed tightly by screws 8 and 8. Numeral 5 represents a pressure mechanism, such as an oil pressure cylinder, which is operated by the oil pressure transmitted from an oil pressure pump through a high pressure hose, not shown. As pressure in the cylinder 5 increases, a piston rod placed in the cylinder 5 is pushed out toward end portion of an adjustable screw 6 as a receiving member, so that base portions of the arms *7a* and *7b* are extended, and two cutting blades 4 and 4 come closer and closer. Numeral 10 represents an indicator plate, which is fixed on axes 3 and 3. On the top face of this plate 10, indications 11*a* and 11*b* are shown, and in opening 12 of this plate, indicator needles 13*a* and 13*b* fixed on arms *7a* and *7b* are placed. Numeral 14 represents a stud bolt fixed on the center of the plate 10, 15*a* and 15*b* represent spring fixing members fixed on side portions of the arms *7a* and *7b*. Between the above stud bolt 14 and spring fixing members 15*a* and 15*b*, two springs acting separately, 16*a* and 16*b*, are placed for a balance regulating mechanism. Each spring 16*a* and 16*b* has a function to pull separately to each other the end portions of the adjacent arms *7a* and *7b*.

Next, operation of the cutting apparatus for a rusty nut of the present invention having the above mechanism will be described.

At first, as shown in FIG. 1, suitable blades 4 and 4 should be settled on top inside portions of the arms *7a* and *7b* according to a size, shape and fixing condition of a nut to be cut off. Next, distance between the blades 4 and 4 should be decided, this distance being equal to or merely as wide as a diameter of a nut to be cut off. This operation is done by operation of adjusting movement of screw mechanisms formed on the oil pressure cylinder 5 and the adjustable screw 6. When this operation is done, indicator needles 13*a* and 13*a* should be checked where positions of the indications 11*a* and 11*b* are indicated, to equalize the opening distance of the two arms *7a* and *7b*. If the indicator needle 13*a* fixed on the arm *7a* is inclined toward the left, the adjustable screw 6 should be drawn out, and the oil pressure cylinder 5 should be pushed out, to put three points, namely the center of a nut to be cut off, the center of the stud bolt 14, and the cross point of the adjustable screw 6 and the top portion 9 of the cylinder rod, in a straight line. Since a relative position of the arms *7a* and *7b* is regulated as described above, balance regulating springs 16*a* and 16*b* pull the arms *7a* and *7b* to come near equally.

As described above, as soon as setting of the main member 1 is complete, as shown in FIG. 1, the cutting blades 4 and 4 are applied to the side portions of a rusty nut to be cut off, and an oil pressure apparatus, not shown, is started to operate. As the oil pressure in the cylinder 5 increases, the piston rod placed in the cylinder is pushed out toward the end portion of the adjustable screw 6, and then the base portions of the arms *7a* and *7b* are moved. Accordingly the arms *7a* and *7b* are rotated through the axes 3 and 3, cutting blades 4 and 4 are inserted into a rusty nut, and soon this rusty nut is cut off.

Moreover, all progress of cutting operation is indicated by movement of the the indicator needles 13*a* and 13*b*. Namely, if the needles 13*a* and 13*b* are not moved equally, it indicates the cutting blades 4 and 4 are not equally cutting off the rusty nut. Accordingly, in this case, the setting condition of the arms *7a* and *7b* should be re-checked, to prevent the cutting blades 4 and 4 from being destroyed. After the cutting operation is over, oil pressure in the cylinder 5 is decreased, and the top portions of the arms *7a* and *7b* are returned to the original position together with the cutting blades 4 and 4 by operation of the balance adjusting springs 16*a* and 16*b*.

In the cutting apparatus for a rusty nut of the present invention, because the balance adjusting springs 16*a* and 16*b* are placed separately to each arm *7a* and *7b*, accordingly, for example, if one side of the arm is moved less than other one, one side of the spring acts more strongly than other. According to this function of the balance adjusting springs 16*a* and 16*b*, the arms *7a* and *7b* are moved simultaneously, and a balance of movement of the arms *7a* and *7b* can be regulated.

Moreover, parts of the construction of the above mentioned embodiment may be changed as described in the following embodiments.

1. The arms may be coupled by an axis only. In this embodiment, projected portions should be formed inside of each of the arms to fix the axis thereon. However it is necesary to design a portion of the axis, on which the indication plate 10 is fixed, in a special shape such as a square to regulate the suitable position of the plate 10.

2. For a pressure mechanism, a conventional oil pressure cylinder or air pressure cylinder can be applied. Moreover, a pressure generating pump is manually or electrically operated.

3. As an adjusting screw 6, which is used to receive the top portion of the piston rod 9, a rod member having no thread can be used. In this case, moreover, it is desirable to provide several rod members having different length.

4. In the first embodiment, bottom faces of the arms near the blades are formed in plan, as shown in FIG. 2, and it is desirable to arrange all mechanism over the bottom faces to enable easy cutting off and removal of a rusty nut without interference by the structure of the cutting apparatus.

5. An indicator member indicating the distance of the arms is not limited within the above structure. Namely a special member or mechanism can be used, by which the three points, namely the center of a nut to be cut off, the stud bolt and connected point of the adjusting screw 6 and top portion of the piston rod, are indicated in a straight line and can easily be checked. Moreover, in a cutting apparatus in which distance between the cutting blades can not be adjusted, it is unnecessary to use an indicator member.

Because the present cutting apparatus for a rusty nut of the present invention, has been described above in detail, the above objects can be easily attained.

What is claimed is:

1. An apparatus for cutting a rusty nut comprising (A) a pair of arms coupled in opposing position by a pair of axes, (B) a pair of cutting blades, each blade affixed to a top inside portion of one of the pair of arms, (C) a pressure mechanism positioned at an end of at least one of the pair of arms, (D) a plate situated on the pair of axes, (E) at least one pair of springs situated between the pair of arms and connected through a coupling member on the plate, said springs actuated separately from one another to equalize balance of movement of said pair of arms, and (F) a member on the surface of the plate for indicating the balance between the pair of arms.

2. An apparatus according to claim 1 additionally comprising a member on the surface of the plate for indicating the balance between the pair of arms.

3. An apparatus according to claim 2 additionally comprising a pair of indicator needles, each needle affixed to a respective arm of said pair of arms, and said indicator needles positioned adjacent to said indicating member on the surface of the plate to register relative position of said pair of arms with one another.

4. An apparatus of claims 2 or 3 wherein said pressure mechanism is adjustable for balancing said pair of arms in response to readings on said indicating member.

5. An apparatus of claim 4 wherein said pressure mechanism comprises (A) an oil cylinder positioned at the end of one of said pair of arms, and (B) an adjustable screw positioned at the end of said other arm, and contacting said oil cylinder.

6. An apparatus for cutting a rusty nut comprising:

(A) a plate having a pair of axes and a coupling member situated thereon equidistant from both axes, (B) a pair of arms rotationally supported by said respective axes, (C) a pair of cutting blades, each blade affixed to a top inside portion of one of the pair of arms, (D) a pressure mechanism positioned at an end of at least one of the pair of arms for moving the ends of the arms apart from each other to thereby move the cutting blades closer together, and (E) at least one pair of springs, each spring located between a respective arm and the coupling member, said springs being actuated indepedently from one another to equalize balance of movement of said pair of arms so that when the pressure mechanism is actuated, pressure on the cutting blades can be equally applied to sever the nut.

* * * * *